US007798070B2

(12) United States Patent
Ooba et al.

(10) Patent No.: US 7,798,070 B2
(45) Date of Patent: Sep. 21, 2010

(54) TABLE

(75) Inventors: Yoshiharu Ooba, Nagai (JP); Kenji Nakamura, Tokyo (JP); Teru Kikuchi, Takahata-machi (JP); Hidetaka Sekikawa, Takahata-machi (JP)

(73) Assignee: Okamura Corporation, Kanagawa (JP)

( * ) Notice: Subject to any disclaimer, the term of this patent is extended or adjusted under 35 U.S.C. 154(b) by 441 days.

(21) Appl. No.: 11/664,770

(22) PCT Filed: Oct. 5, 2005

(86) PCT No.: PCT/JP2005/018432

§ 371 (c)(1),
(2), (4) Date: Jul. 2, 2007

(87) PCT Pub. No.: WO2006/038649

PCT Pub. Date: Apr. 13, 2006

(65) Prior Publication Data

US 2008/0028996 A1 Feb. 7, 2008

(30) Foreign Application Priority Data

Oct. 5, 2004 (JP) ..... 2004-292590
Oct. 5, 2004 (JP) ..... 2004-292594
Aug. 5, 2005 (JP) ..... 2005-228298

(51) Int. Cl.
*A47F 5/12* (2006.01)

(52) U.S. Cl. ..... 108/7; 108/50.01; 108/147

(58) Field of Classification Search ..... 108/1, 108/7, 50.01, 50.02, 147, 147.11; 312/195, 312/223.3; 248/404, 371, 157, 420, 188.2
See application file for complete search history.

(56) References Cited

U.S. PATENT DOCUMENTS 2,234,483 A * 3/1941 Sutton ..... 108/7
5,131,333 A * 7/1992 Karasawa et al. ..... 108/7
5,398,622 A * 3/1995 Lubinskas et al. ..... 108/145
5,704,299 A * 1/1998 Corpuz et al. ..... 108/50.01
5,967,631 A * 10/1999 Ko ..... 108/50.01
6,038,986 A * 3/2000 Ransil et al. ..... 108/147
6,267,064 B1 * 7/2001 Ostertag et al. ..... 108/50.02
6,332,407 B1 * 12/2001 Vardaro ..... 108/50.01

(Continued)

FOREIGN PATENT DOCUMENTS

JP 62-49807 3/1987

(Continued)

*Primary Examiner*—José V Chen
(74) *Attorney, Agent, or Firm*—Davis & Bujold, P.L.L.C.

(57) ABSTRACT

A top plate is supported while being greatly projected forward of leg bodies, which forms a large lower leg space under the top plate. Upper ends of left and right leg bodies (2) having, at their lower ends, base legs (2*a*) that are directed in a front-rear direction are connected by lateral connection rods (3) that are directed in a left-right direction and have a non-circular cross-section. Rear end sections of at least a left and right pair of top plate support bodies (4) directed in the front-rear direction are fixed to the lateral connection rods (3) so as to project forward. The lower surface of the top plate (26) is installed on the top plate support bodies (4) such that the most part of the top plate (26) is located forward of the lateral connection rods (3).

9 Claims, 10 Drawing Sheets

U.S. PATENT DOCUMENTS

| | | | | |
|---|---|---|---|---|
| 6,336,414 | B1 * | 1/2002 | Stewart et al. | 108/50.02 |
| 6,415,723 | B1 * | 7/2002 | Kopish et al. | 108/50.02 |
| 6,895,869 | B2 * | 5/2005 | Lai | 108/50.02 |
| 6,912,960 | B2 * | 7/2005 | Tsai | 108/50.01 |
| 2004/0237852 | A1 * | 12/2004 | Tsai | 108/50.01 |

FOREIGN PATENT DOCUMENTS

| | | |
|---|---|---|
| JP | 3-30021 | 6/1991 |
| JP | 4-53694 | 12/1992 |
| JP | 5-228028 | 9/1993 |
| JP | HO5-95329 | 12/1993 |
| JP | 9-299154 | 11/1997 |
| JP | 2001-128741 | 5/2001 |
| JP | 2001-269228 | 10/2001 |

* cited by examiner

TABLE

This application is a national stage completion of PCT/JP2005/018432 filed Oct. 5, 2005 which claims priority from Japanese Application Ser. No. 2004-292590 filed Oct. 5, 2004, which claims priority from Japanese Application Ser. No. 2004-292594 filed Oct. 5, 2004, which claims priority from Japanese Application Ser. No. 2005-228298 filed Aug. 5, 2005.

TECHNICAL FIELD

The present invention relates to a table suitable to operate office automation equipment such as a personal computer.

BACKGROUND OF THE INVENTION

A known table comprises a pair of inverse T- shaped, I-shaped or gate-like legs; a lateral cross beam connecting the legs to each other a top supported by the legs.

JP5-228028A discloses that a pair of legs is coupled to each other at the rear end with a cross beam and that the lower surface of the top is supported by a pair of supports of the legs.

JP3-30021Y2 discloses that an auxiliary top on which a key board thereon is mounted to a pair of legs with a parallel link to allow the auxiliary top to move horizontally between an operating position in front of the main top and an inoperative position in which it is stored under the main top.

A desk or a table having an operating device is described in JP4-53694Y and JP2001-128741A.

JP62-49807A discloses a device that comprises a parallel link for supporting a moving member; a locking unit supported by the parallel link to lock an angle of the moving member with a frictional force; and a force-promoting unit mounted between a leg and the moving member to assist up-and-down motion and rotation of the moving member, rotation of the parallel link enabling the moving member to go up and down, releasing of the unlocking unit enabling the angle of the moving member to vary.

In an ordinary table or the table in JP5-228028A, the lower surface of the top is supported by a pair of legs directly, so that the depth of the top is limited not to enable a leg space to be produced under the top.

Thus, when a person operates a key board on the top in an easy posture in which one's legs deeply extend under the top, a chair or one's leg of the person becomes closer to the legs of the table, so that relaxed feeling cannot be achieved.

It is not possible to adjust the height and angle of the top, so that the person cannot operate the key board at suitable posture.

In the table in JP3-30021Y, the auxiliary top can be situated in front of the main top to avoid the former disadvantages. But, when the auxiliary top is stored under the main top, it makes it difficult to work in front of a table.

The auxiliary top is horizontal in use, and is not adjustable on its angle.

As well as the above, it is not possible to operate a key board suitably.

In the operating device in JP4-53964Y and JP2001-128741A, an operating lever or portion for adjusting a height of a top is provided at each side of the lower surface of the front end of the top and pulled to allow a height of the top to be adjusted. Thus, it is difficult to operate the lever in a posture where one's legs are deeply placed under the top while one still sits on the chair.

JP4-53694Y discloses that there is an opening at the lower surface of the front end of the top. An operating lever is provided in the opening thereby making it difficult to put a hand into the opening.

The operating portion in JP2001-128741A projects from the lower surface of the top thereby making its appearance worse. One's knee is likely to strike the operating portion.

In JP6249807A, the moving member by the parallel link or a support point for the top and a connecting point between the force-promoting unit and the top are provided on the front part of the top to make the support of the top unstable. If a heavy object is put on the rear part of the top, greater moment is applied to the support point of the top to let the top inclined downwards. The end of the parallel link is likely to be damaged.

SUMMARY OF THE INVENTION

In view of the disadvantages in the prior art, it is an object of the present invention to solve the problems below:

(A) to provide a table in which a greater leg space is formed under the top by supporting the top that projects from the leg of the table greatly to achieve feeling of freedom when one's leg is deeply put under the top and to adjust height and angle of the top suitably depending on its use:

(B) to provide an operating unit for actuating a gas spring to enable it to be operated easily while one still sit on a chair to improve operativity and appearance; and (C) to provide a table in which the top is stably supported and is easily changed on an angle easily and naturally, a greater space being formed under the top.

DETAILED DESCRIPTION OF PREFERRED EMBODIMENTS

Figure 1:
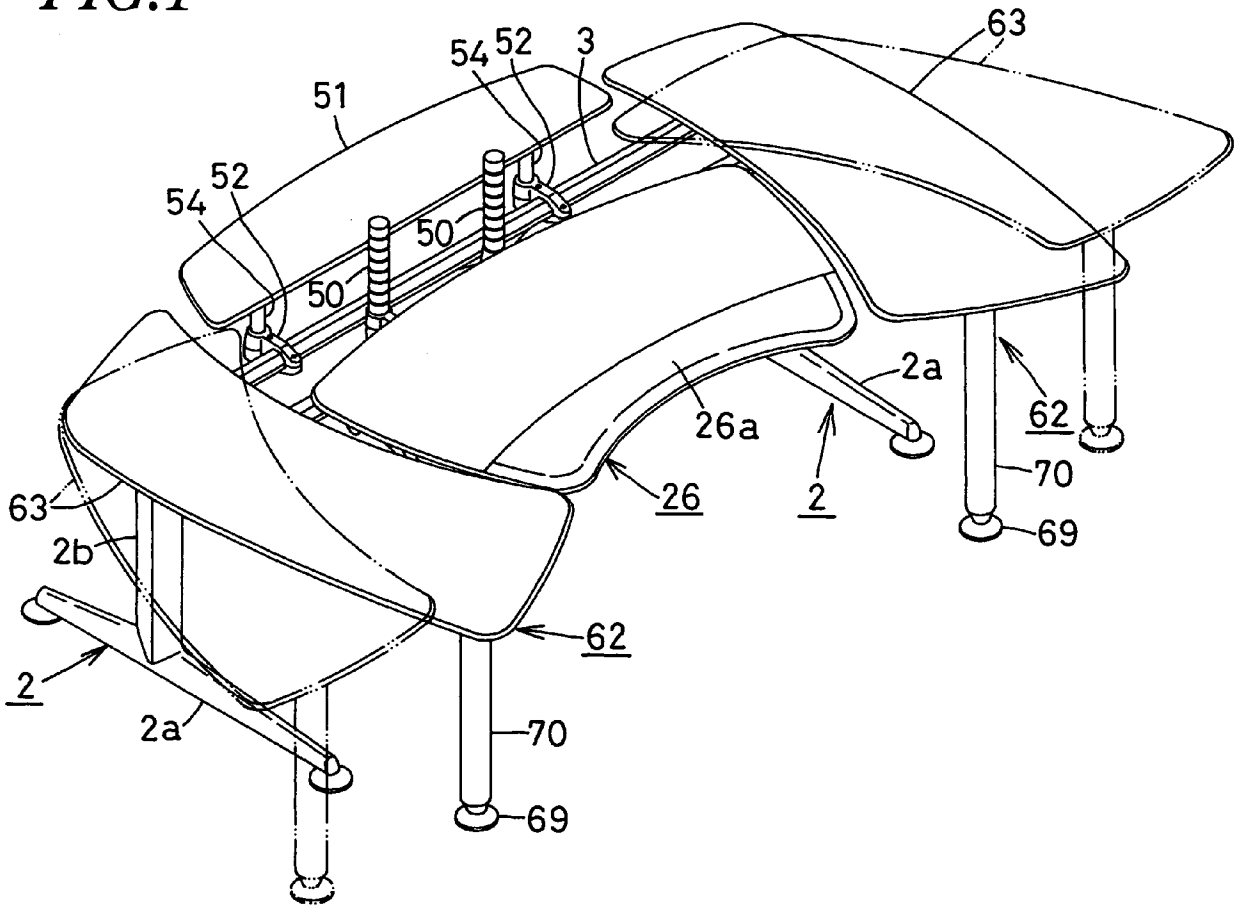
FIG. 1 is a perspective view of one embodiment of a table according to the present invention.
Figure 2:
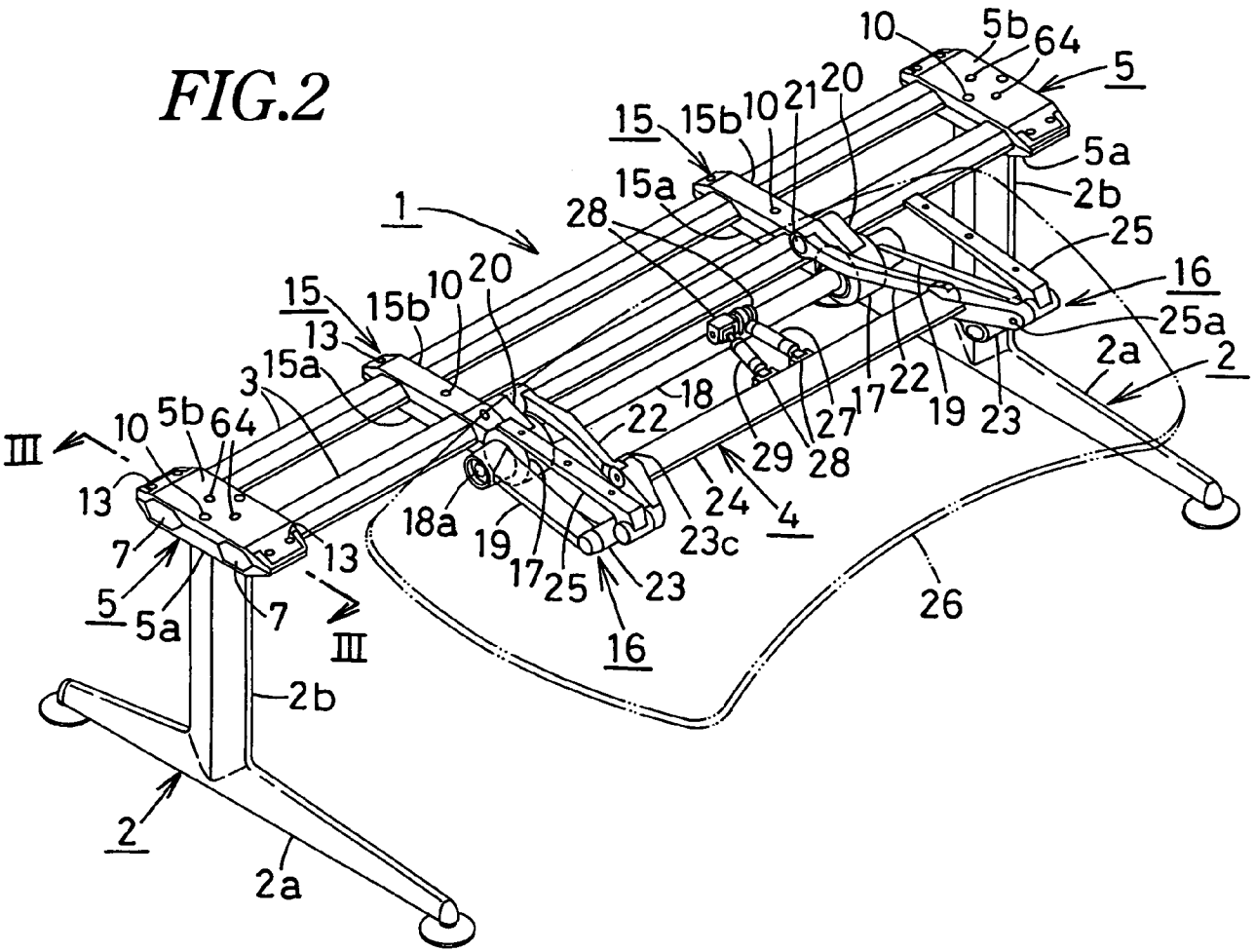
FIG. 2 is a perspective view of a support frame of the table.

FIG. 1 is a perspective view of a table for operating office automation equipment according to the present invention, and FIG. 2 is a perspective view of a support frame for the table.

The support frame 1 comprises a pair of legs 2,2 in parallel; a pair of cross beams 3,3 in parallel for connecting the legs 2 to each other; and a top support 4 in front of the middle of the cross beams 3,3.

The leg 2 comprises a leg base 2*a* and a leg post 2*b* having an elliptical cross-section. At the upper end of the leg post 2*b*, a support member 5 is fixed to support each end of the cross beam 3.

Figure 3:
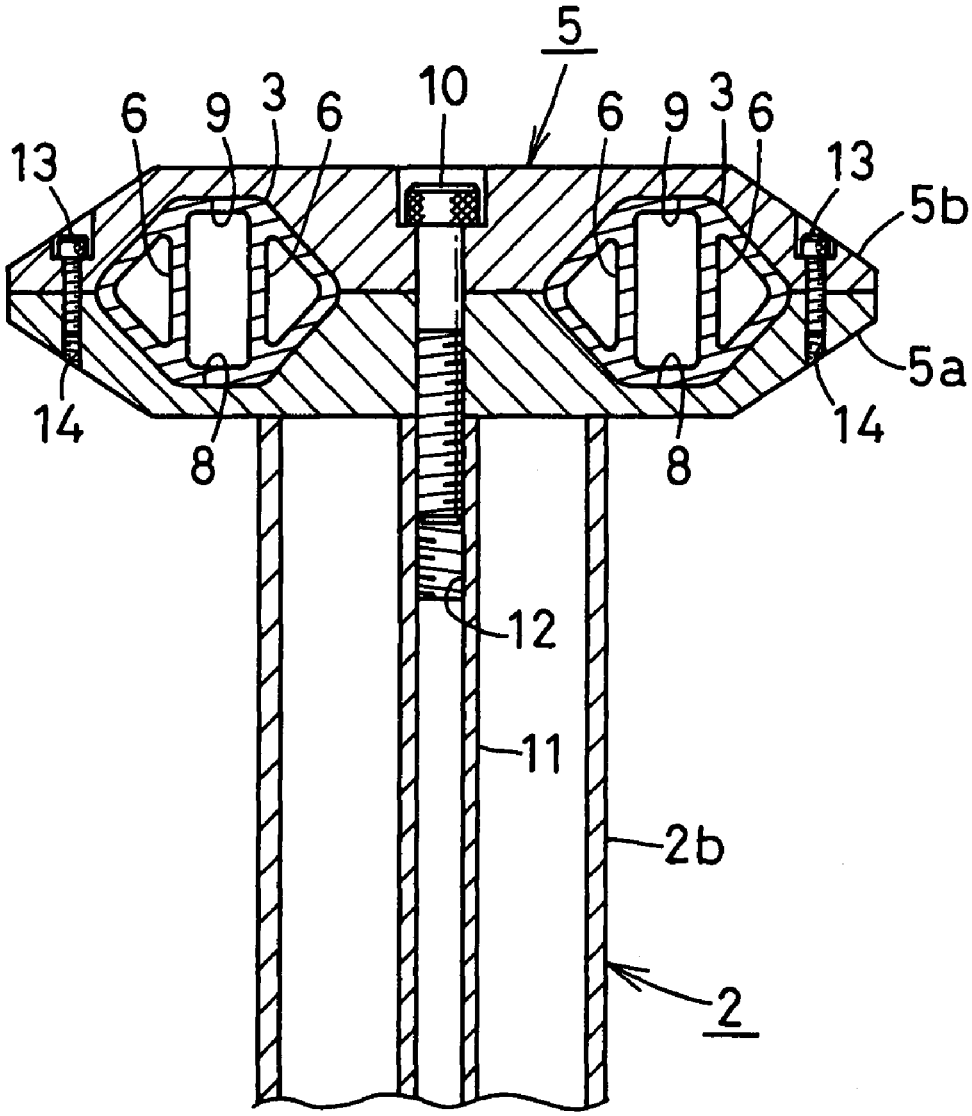
FIG. 3 is an enlarged vertical sectional side view taken along the line III-III in FIG. 2.

In FIG. 3, the cross beam 3 is made of Al alloy having a hexagonal cross-section and has a pair of vertical-plate reinforcement ribs 6,6 in parallel.

An opening at each end of the cross beam 3 is closed by an end cap 7.

In FIG. 3, the support member 5 comprises a support plate 5*a* which has a groove 8 in which a lower half of the cross beam fits; and a holding plate 5*b* which has a groove 9 in which an upper half of the cross beam 3 fits.

After each end of the cross beam 3 fits in the grooves 8,8 of the support plates 5*a*, the upper half is covered with the groove 9 of the holding plate 5*b*.

A bolt 10 passes through the middle of the support plate 5*a* and the holding plate 5*b* and is engaged in a female thread 12 at the upper end of a tube 11 in the hollow leg post 2*b*. Two bolts 13 which pass through the holding plate 5*b* are engaged in female threads 14 to allow the leg post 2*b* and the support member 5 to be fixed with each end of the cross beam 3 firmly.

When the holding plate 5*b* is tightened over the support plate 13 with the bolts 10,13, a slight gap is formed to allow each end of the cross beam 3 to be fastened tightly with the support member 5.

The hexagonal cross-section of the cross beam 3 which horizontal upper and lower surfaces allows the height of the support member 5 to become smaller thereby improving appearance, facilitating mounting of optional parts (later described) and positioning the support member 5 easily in a horizontal direction.

The six outer peripheral surfaces of the cross beam 3 is firmly fixed by the support member 5 to prevent the support member 5 from rotating on its own axis or from loosening.

Furthermore, a pair of reinforcement ribs 6 are provided within the cross beam 3 to prevent the cross beam 3 from bending down or being twisted.

The cross-section of the cross beam 8 may be an octagon which has horizontal upper and lower surfaces, other polygon or other noncircular shape.

The top support 4 comprises a pair of support members or support brackets 15,15 mounted to the connecting member 3; and a pair of parallel links 16,16 pivotally mounted to the front ends of the support brackets 15,15.

The support bracket 15 is smaller in width than the support member 5 and has grooves (not shown) in an upper support plate 15*a* and a lower holding plate 15*b* engaging on the upper and lower halves of the cross beam 3. The support bracket 15 is firmly fixed to the cross beam 3 with bolts 10,13 in FIG. 3.

In FIGS. 4-8, the parallel link 16 comprises a shaft 18*a* which passes through a rectangular bar 18 which connects bearings 17,17 to each other at the front ends of the upper holding plate 15*b* of the support brackets 15; the first link arm 19 which engages at the rear end with outer projecting ends of the shaft 18*a*; the second link arm 22 which is upper than the first link arm 19 and pivotally secured with a pivot 21 to an upward projection 20 of the holding plate 15*b*; an up-and-down member 23 pivotally secured to the front ends of the first and second link arms 19,22 with shafts 23*a*,23*b*; and a connecting member 24 which connects the up-and-down objects 23,23 to each other.

The front end of the second link arm 22 is positioned by putting in a groove 23*c* at the rear end of up-and-down object 23. The front end of the second link arm 22, the up-and-down object 23 and the connecting member 24 are connected with the shaft 23*b*.

The upper front end of the up-and-down object 23 is pivotally secured to the front end of the top support arm 25 fixed to the lower surface of the top 26 with a shaft 25*a* in front of the center G of gravity of the top 20.

The top 26 is a reverse trapezoid in a top plan view having an inward-curved front end and an outward-curved rear end and has a hand-putting part 26*a* made of slightly-soft elastomer resin 26*a*.

Figure 10:
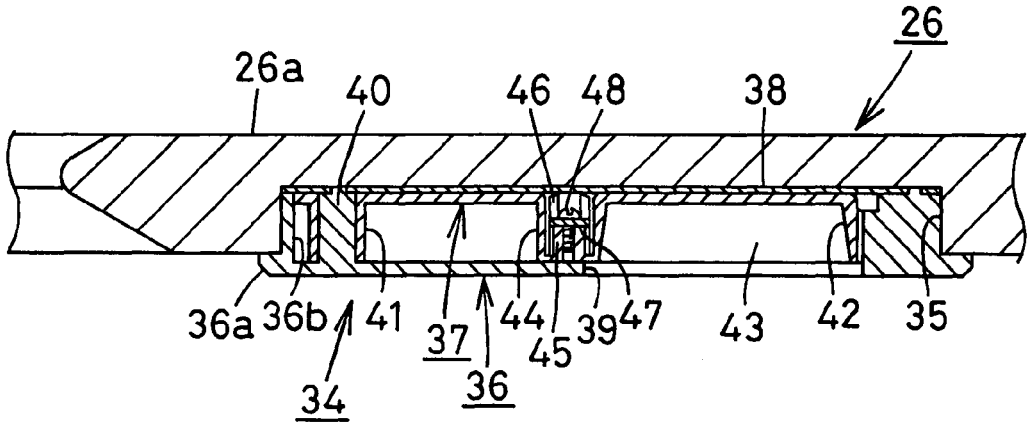
FIG. 10 is an enlarged vertical sectional view taken along the line X-X in FIG. 8.

The outer periphery of the hand-putting part 26*a* has a lower inclined surface to reduce its thickness in FIG. 10.

Owing to such shape of the top 26, the center G of gravity is positioned behind the center of the top 26 to allow the top 26 to be supported stably even when the top 26 extends from the leg 2 greatly. The top 26 is positioned to surround a user to make its use advantageous especially when one operates a lot of office automation equipment on the top 26.

The parallel links 16,16 are mounted to the front ends of the support brackets 15,15 fixed to the front and rear cross beams 3 to allow the top 26 to be supported by the top support arms 25,25 pivotally secured to the front end, thereby enabling the top 26 to be mounted, while the top 26 projects forwards from the leg post 2*b* and the cross beam 3.

Thus, under the top 26, a great space is created to enable the user to operate a key board on the top 26 in a relaxed posture where one's leg is placed deeply under the top 26.

Furthermore, the second link arm 22 of the parallel link 16 is higher than the first link arm 19. Between the right and left second link arms 22, a leg space is formed. A finger or clothes are not likely to be held between the first and second link arms 19 ands 22.

The right-and-left parallel links 16 and 16 are connected to each other with the cross beams 18,24 to enable the parallel links 16,16 to turn synchronously.

The front and rear cross beams provide high strength against bending or twisting as mentioned above. Thus, even when the top 26 which projects forwards is supported, disadvantages are not likely to occur, so that the weight of the top 26 is borne surely and stably.

Loosening the bolts for the support bracket 15 enables mounting positions of the parallel links 16 and the top 26 to change horizontally.

In the middle of the cross beam 24 and the cross beam 18, the first hydraulic locking gas spring 27 for adjusting height is pivotally secured at the front end to the cross beam 24 and at the rear end to the cross beam 18 via U-shaped brackets 28,28 to apply upward force when the top 26 is moved up and down by the parallel links 16.

In the middle of the top 24 and in a recess 26*b* of the lower surface of the top 26, the second hydraulic gas spring 29 with a lock for tilting the top 26 is pivotally secured via U-shaped brackets 28,28 to apply upward force when the top 26 is tilted down forwards.

Figure 4:
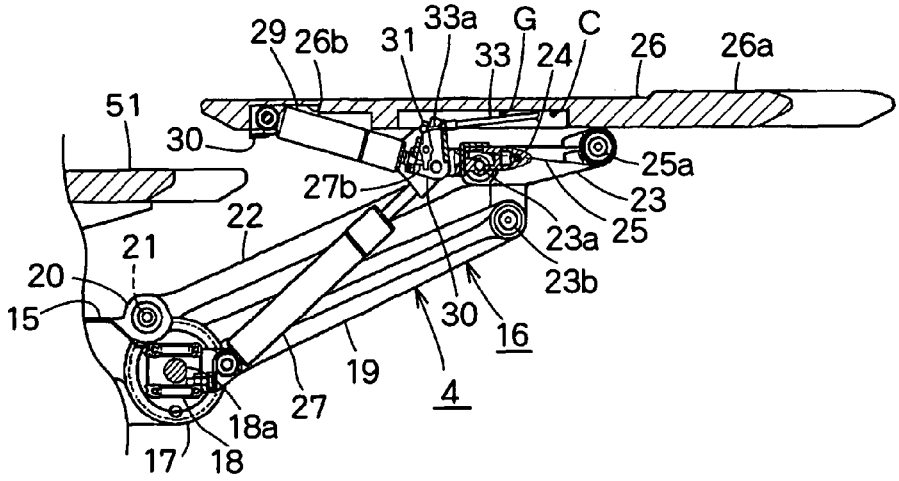
FIG. 4 is a central vertical sectional side view of a support for a top when the top is horizontal.
Figure 5:
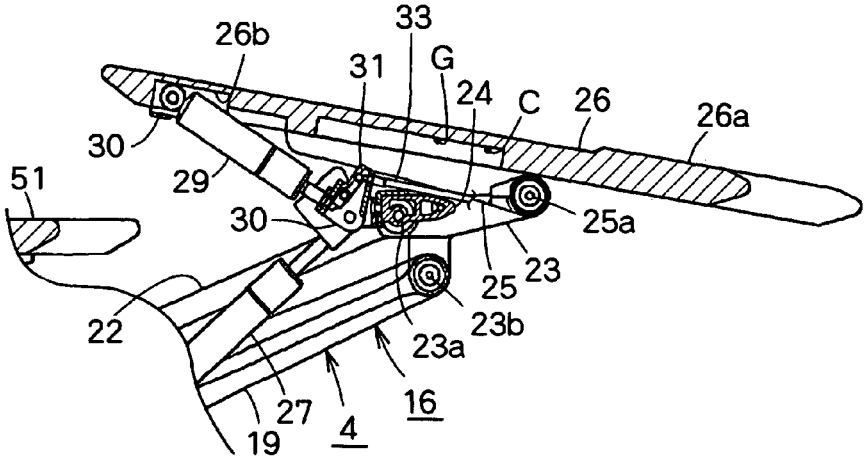
FIG. 5 is a central vertical sectional view of the support for the top when the top is tilted forwards.
Figure 9:
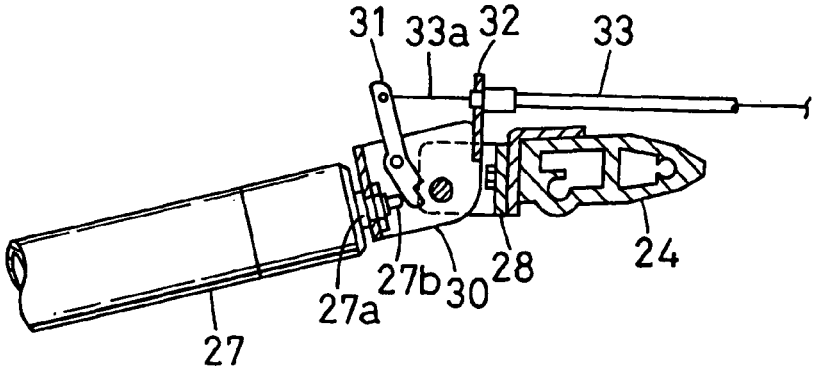
FIG. 9 is an enlarged vertical sectional side view taken along the line IX-IX in FIG. 8.

In FIGS. 4 and 9, in the first and second gas springs 27,29 (only the first gas spring the same as the second one is shown), a valve 27*b* which projects from the front end of the piston rod 27*a* is pressed by the lower end of an operating lever 31 pivotally secured to a connector 30 which connects the piston rod 27*a* to the bracket 28 to allow them to be unlocked to enable the piston rod 27*a* to project by internal gas pressure.

The upper end of the operating lever 31 is coupled to one end of a wire 33*a* passing through an outer cable 33 coupled to a support piece 32 of the connector 30.

Figure 8:
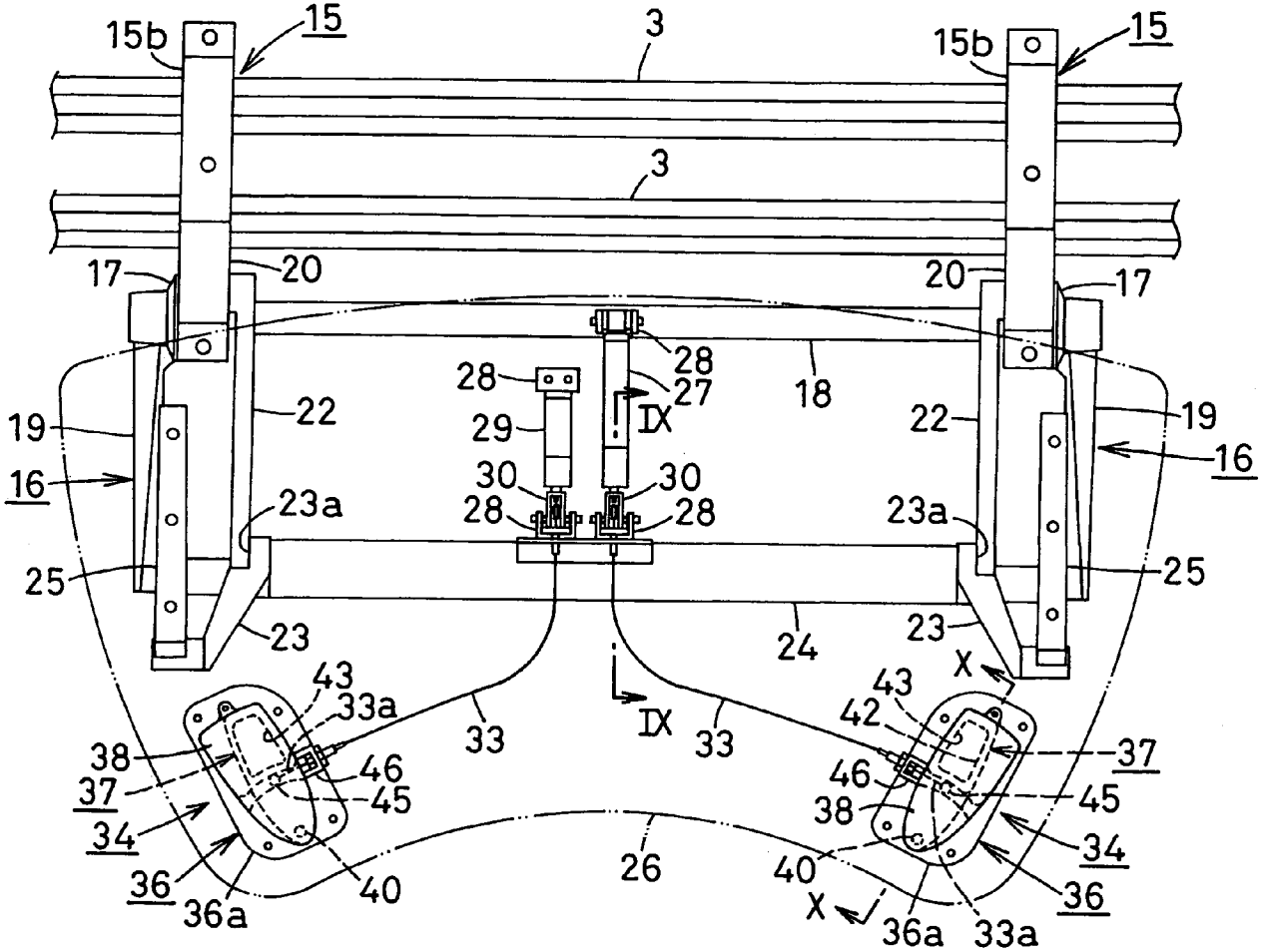
FIG. 8 is a top plan view of a parallel-link mounting potion and an operating unit for a gas spring.

In FIGS. 8 and 10, at the front inner corners on the lower surface of the hand-putting portion 26*a* of the top 26, there are hydraulic unlocking units 34,34 in which the outer cables 33 for the first and second gas springs 27,29 are coupled to the other ends of the wires 33*a*.

The two unlocking units 34,34 are symmetrical and comprise the same structure, and only the right-side unlocking unit 34 will be described.

The unlocking unit 34 fits in a recess 35 in the lower surface of the hand-putting portion 26*a*, and comprises a U-shaped support base 36 in which a peripheral portion 36*a* is bolted to the lower surface of the top 26; an operating lever 37 received in a recess 36*b* of the support base 36; and a cover plate 38 which covers an opening surface of the upper end of the support base 36.

The recess 36*b* of the support base 36 is substantially elliptical and has a straight line at the rear end. The rear part of the bottom surface is open.

A pivot 40 projects from the upper surface of the front part of the recess 36*b*.

The operating lever 37 is elliptical and is slightly narrower than the recess 36*b* of the support base 36. A pivotal tube 41 which projects downwards at the front part fits on the pivot 40 of the support base 36 to allow the operating lever 37 to turn horizontally around the pivot 40 in the recess 37.

Over the opening 39 of the support base 36 at the rear part of the operating lever 37, a hand-engaging portion 43 is surrounded by a rectangular frame 42.

On the upper surface of a groove of a downward projection 44 of the operating lever 37, an engagement projection 45 projects to engage with the wire 33*a*.

The other end of the outer cable 33 is secured to a holding portion 46 which projects inwards from the inner side surface of the support base 36. The other end of the wire 33*a* which projects from the outer cable 33 is coupled to the operating lever 37 by mounting a washier 47 to the engagement projection 45 with a screw 48.

The front side edge of the top 26 is held by a hand. A thumb of the hand is placed on the top 26, while the other four fingers are inserted in the hand-engaging recess 43 of the operating lever 37. The four fingers are pulled outwards horizontally to allow the operating lever 37 to turn outwards horizontally around the pivot 40, so that the wire 33*a* is pulled.

Thus, the operating lever 31 is rotated to press the valve 27*b* to allow the first gas spring 27 to become free.

The top 26 applied by the upward force by the gas spring 27 can be moved up and down freely by turning the parallel link 16 up and down.

Figure 6:
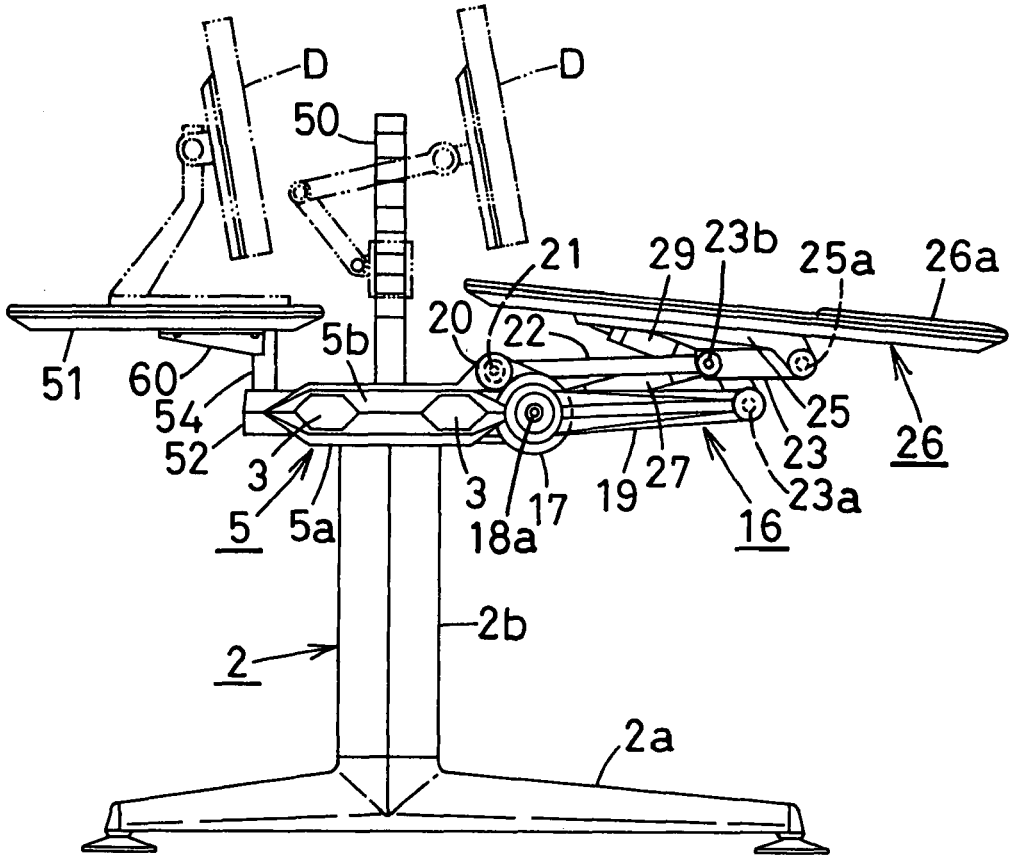
FIG. 6 is a side view when a side table is removed.
Figure 7:
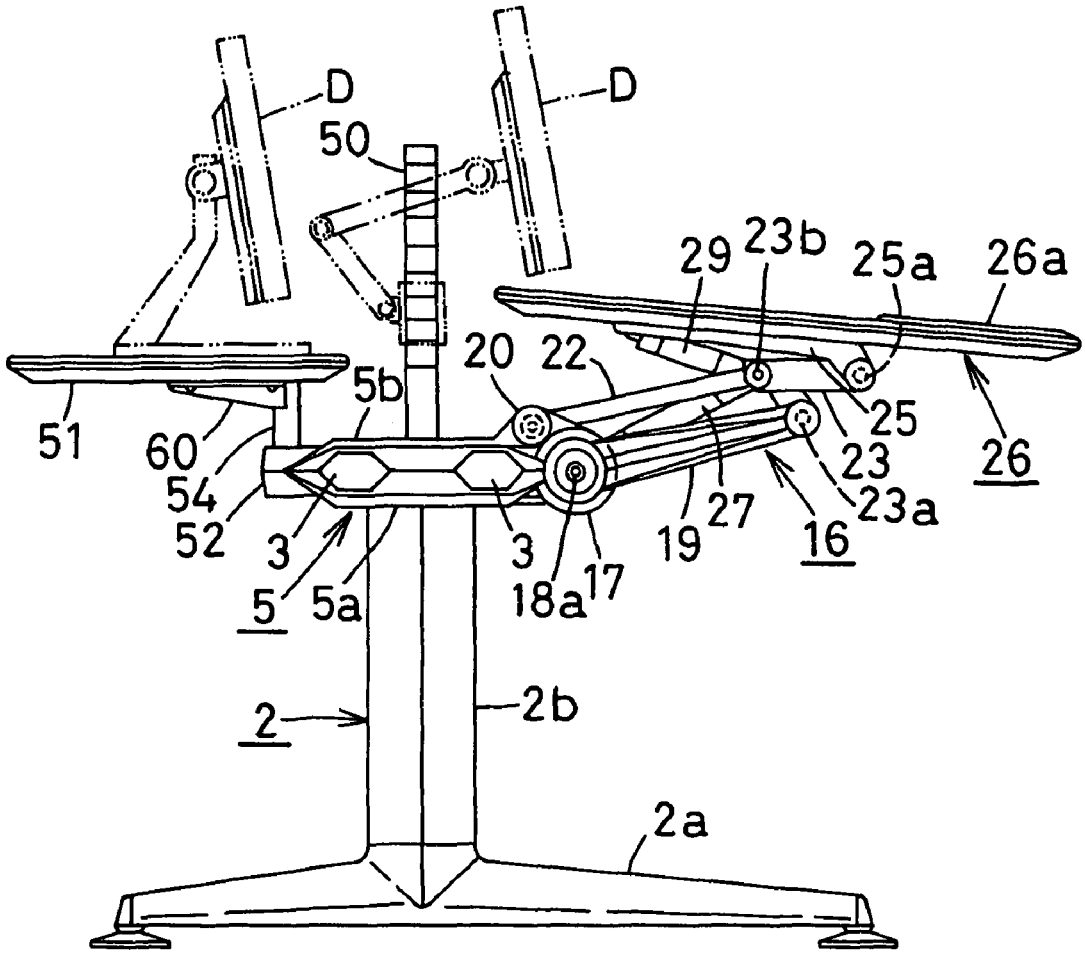
FIG. 7 is a side view when the top rises.

Taking one's hand off the operating lever 37 at an optional position allows the first gas spring to be locked in FIGS. 6 and 7, so that the height of the top 26 is adjusted.

If the top 26 is heavy, a supplemental forcing unit (not shown) such as a torsion coil spring may be provided between the cross beam 18 of the parallel link 16 and the first link arm 19 not to cause the top 26 to move down by its own weight when the first gas spring 27 is unlocked.

When the left-side operating unit 34 is operated as well, the second gas spring 29 is unlocked to become free to allow the top 26 to turn up and down around a pivot of the top support arm 25. Releasing the operating lever 37 at an optional position makes the second gas spring 29 locked, so that the top 26 is adjusted at a desired tilted position in FIG. 6.

As mentioned above, the top 26 comprises a reversed trapezoid. The operating units 34,34 for actuating the first and second gas springs 27,29 are provided on the lower surface of the inner front corners along the same direction as the side end face of the hand-engaging portion 26*a* and can be turned horizontally in a forwardly-inclined direction to allow both hands of a sitting person to become closer to the right-and-left operating units 34,34, so that one can easily turn the right-and-left operating levers 37,37 by both hands while one is still sitting.

When one grasps the front corner of the top 26, the four fingers other than the thumb naturally touch the operating lever 37 enabling the height and angle of the top 26 to be adjusted together with operation of the operating lever 37.

In FIGS. 1, 6 and 7, the front and rear cross beams 3,3 may include two support poles 50,50 and an auxiliary top 51 which will be mounted below.

Figure 11:
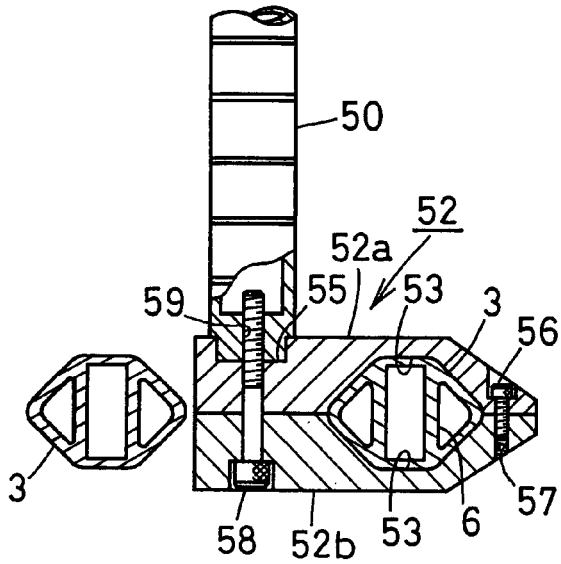
FIG. 11 is a vertical sectional side view of a support pole mounting portion.
Figure 12:
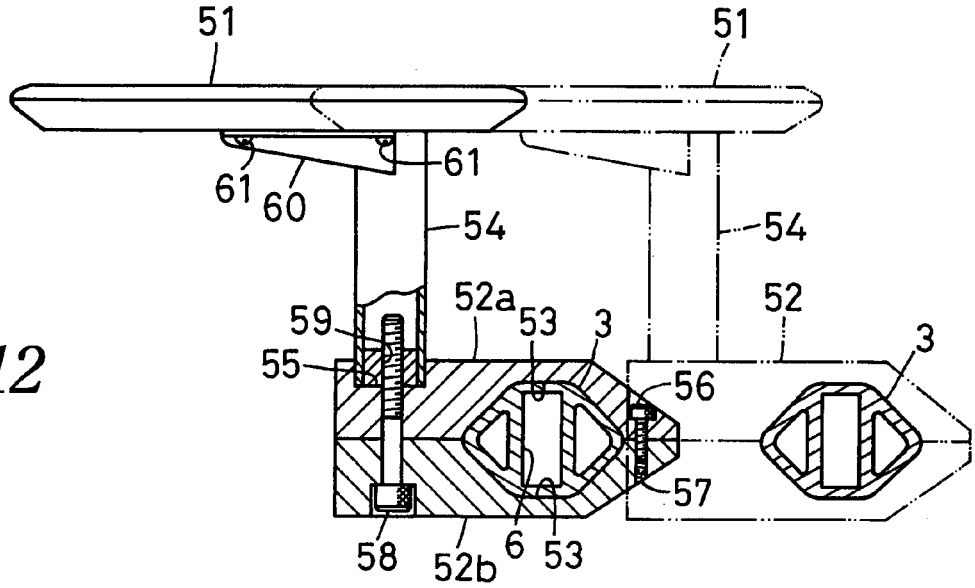
FIG. 12 is a vertical sectional side view of a subsidiary top mounting portion.

In FIGS. 11 and 12, a mounting member 52 for mounting the support pole 50 and the auxiliary top 51 comprises a pair of fixing plates 52*a*,52*b* which have grooves 53,53 in which upper and lower halves of the cross beam 3 fit respectively. The upper fixing plate 52*a* of the fixing member 52 includes grooves 55,55 at the upper rear surface. The lower ends of the support pole 50 and a strut 54 for the auxiliary top 51 fit in the grooves 55,55 respectively.

After the cross beam 3 fits in the grooves 53 of the upper and lower fixing plates 52*a*,52*b*, a bolt 56 which passes through the upper fixing plate 52*a* engages with a female thread bore 57 of the lower fixing plate 52*b*. A bolt 58 which passes through the rear parts of the upper and lower fixing plates 52*a*a,52*b* is screwed in a female thread bores 59 at the lower ends of the support pole 50 and strut 54 the lower ends of which fit in the grooves 55. By tightening the bolt 58, the mounting member 52 is firmly fastened to the front or rear cross beam 3, and the support pole 50 and the strut 54 are fastened on the mounting member 52.

To fasten the support member 52 to the cross beam 3, a slight gap for a tightening region is formed between the upper and lower fixing plates 52*a* and 52*b*.

As shown by dotted lines in FIGS. 11 and 12, the depth of the mounting member 52 is determined such that the rear end of the front mounting member 52 does not touch the rear cross beam 3 when the mounting member 52 is fastened to the front mounting member 52.

To the upper end of the strut 54, the lower surface of the auxiliary top 51 is mounted by fastening a bracket 60 fixed to the strut 54 with a plurality of screws 61.

In FIG. 6, a display for a personal computer can be mounted to the support pole 50 or the auxiliary top 51 so that its height can be adjusted.

As shown by dotted lines in FIG. 12, the mounting member 52 is fastened to the front cross beam 3, so that the auxiliary top 51 is located at the front side, so that it can be approached to the top 26 thereby allowing the user to watch the display D more easily.

The mounting member 52 may be fastened to the rear cross beam 3 by reversing the mounting member 52 by 180 degrees, so that the auxiliary top 51 can be located forward. In such a location, the support pole 50 may be removed.

The cross beam 3 extends through the mounting member 52. So by loosening the bolts 56,58, the mounting position can be optionally changed right and left.

The cross beam 3 has a hexagonal cross-section which enables mounting strength of the mounting member 52 to become greater. The mounting member 52 is fastened to only one cross beam 3 to enable the load of the display D to be supported enough. To bear greater load, the mounting member 52 has a cross-section in FIG. 3 and may hold the front and rear cross beams 3.

Figure 13:
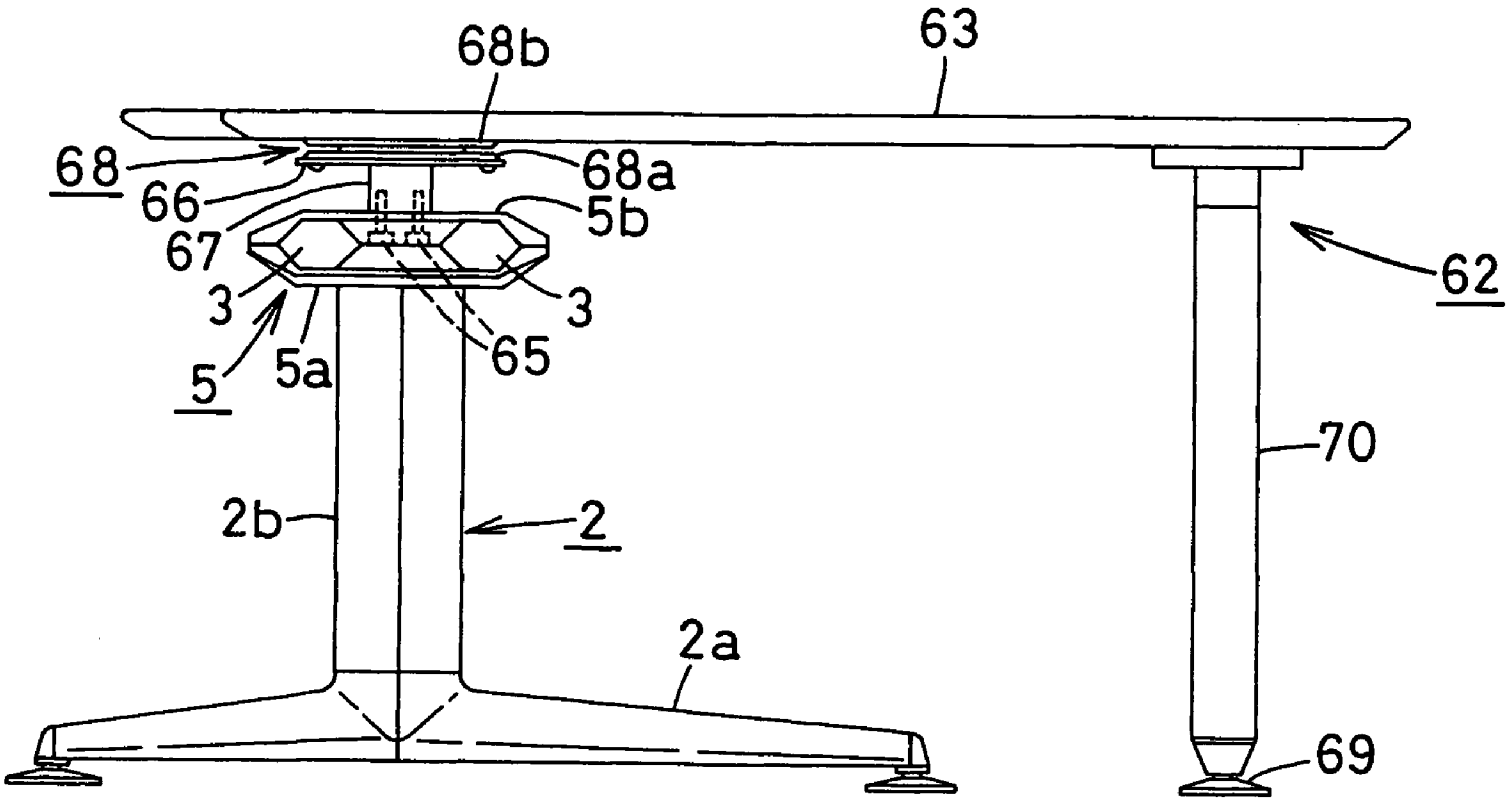
FIG. 13 is a side elevational view of a side table.

In FIGS. 1 and 13, on the upper surface of the support member 5 fixed to the upper ends of the right-and left legs 2, a subsidiary top 63 of a rectangular side table 62 is pivotally mounted sideward in a horizontal direction.

The side table 62 is longer than the top 26.

In the middle of the upper holding plate 5*b* of the support member 5, two bores 64 are formed and a screw 65 is inserted into the bore 64 before the holding plate 5*b* is fastened to the lower support plate 5*a*. The upper part of the screw 65 is engaged though a female thread bore (not shown) at the lower end of a fastening rod 67 projecting from the lower surface of a support base plate 66 to allow the support base plate 66 to be fastened horizontally slightly above the support member 5.

Then, on the upper surface of the support base plate 66, a known rotary support unit 68 which comprises a fastening base 68*a* and a rotary plate 68*b* disposed rotatably via a number of balls (not shown) is mounted by screwing the fastening base 68*a*.

By screwing the rotary plate 68*b* to the middle of the lower surface of the rear end of the subsidiary top 63, the side table 62 can be horizontally pivoted around the support member 5 by the top 26.

The middle of the lower surface of the front part of the subsidiary top 63 is fixed to the upper end of a support leg 70 which has a height adjuster 69 at the lower end.

In FIG. 1, the inner side end of the subsidiary top 63 is curved outwards at almost equal curvature as the outer side end of the top 26 so that they become closer to or are in contact with each other when the top 63 turns at the maximum.

When the subsidiary top 63 turns at the maximum, the front end of the subsidiary top 63 becomes continuous almost like arc with the front end of the top 26.

As mentioned above, the subsidiary top 63 of the side table 63 is pivotally mounted sideward in a horizontal direction to the upper end of the leg post 2*b* of the leg 2 or the upper surface of the support member 5 at the side of the top 26 thereby enabling the right-and left subsidiary tops 63 to turn independently and become greater at a turning area.

Specifically, the right-and-left subsidiary tops 63 are allowed to turn greatly sideward to enable the side table 62 to become longer in a right-and-left direction, so that a plurality of persons can use them as working table.

The subsidiary top 63 is turned inwards to the maximum position and the upper surface of the top 26 is made horizontal and coplanar with the upper surface of the subsidiary top 63 thereby forming a continuous greater top surface, so that larger operation area can be created and location area for office automation equipment can be expanded.

The present invention is not limited to the foregoing embodiments.

In the foregoing embodiment, the top support 4 for supporting the top 26 or a pair of parallel links 16 is provided in the middle of the cross beam 3 connecting the legs 2 and 2 to each other via the support bracket 15. But, to extend the length of the top 26 without the side table 62, the top support 4 may be provided to the support member 5 fixed to the upper end of the leg post 2*b*.

If it is not required to adjust the height and angle of the top 26, the parallel links 16 and gas springs 27,29 may be omitted. Instead, the support brackets 15 and top support fixed thereto may be projected forwards and the lower surface of the top 26 may be directly mounted thereto.

In the foregoing embodiments, the support base 36 is engaged in the recess 35 at the front corner of the lower surface of the top 26 and the operating lever 37 is received in the recess. But without the support base 36, the support lever 37 is pivotally secured in the recess via a vertical pivot directly.

To enable one of the height and angle of the top 26 to be adjusted, the operating unit 24 may be provided at one of right-and-left sides.

Furthermore, without the gas spring 27 for raising the parallel links 16 and stopping rotation thereof, a suitable stopper may be provided to stop the top 26 at the lower and upper limits.

What is claimed is:

1. A table comprising:

a top;

a pair of legs each of which has a leg base at a lower end;

a cross beam having a noncircular cross section and connecting upper ends of said pair of legs to each other, and a pair of top supports coupled to the cross beam and a lower surface of the top such that most of the top is located in front of the top support, wherein the top support comprises:

support members, each being fixed to either the leg or the cross beam; and parallel links, each having a front end and a rear end, the rear end being pivotally coupled to a front end of the support member, and the front end of the parallel link being pivotally coupled to a lifting member for lifting the top, wherein the table further comprises a hydraulic locking gas spring for suitably adjusting a height of the top, the hydraulic locking gas spring generating an upward force that is applied to the parallel link and the hydraulic locking gas spring locking vertical pivoting movement of the parallel link, and the hydraulic locking gas spring connecting a first cross beam, which connects the lifting members, and a second cross beam which connects the front ends of the support member.

2. The table according to claim 1, wherein each of the pair of top support comprises a pair of upper and lower support members that hold the cross beam with fasteners.

3. The table according to claim 1, wherein two cross beams are provided in parallel and fastened to the top support.

4. The table according to claim 1, wherein the cross beam has a polygonal cross section.

5. The table according to claim 1, wherein a front end of the lift member is pivotally secured to a front end of a top support arm via a pivot, and the lower surface of the top being mounted to the top support arm.

6. The table according to claim 1, wherein there is a hydraulic locking gas spring for tilting the top between the cross beam and the top to apply upward rotation-promoting force to the top and to lock the top at a desired angle.

7. The table according to claim 6, wherein a front edge of the top is arcuate to allow the center of gravity to be positioned at the back of a center of the top.

8. The table according to claim 1, wherein the hydraulic locking gas spring unit comprising a valve and a piston rod, a hydraulic unlocking unit is fixed to a lower surface of the top remote from the hydraulic locking gas spring unit and communicates, via a cable, with an operating lever, the operating lever is biased by the hydraulic unlocking unit to press the valve which manages an internal pressure of the hydraulic locking gas spring unit and facilitates unlocking of the hydraulic locking gas spring unit.

9. A table comprising:

a top;

a pair of legs;

a shaft that extends longitudinally of the table;

a pair of top supports extending forwards of said pair of legs, a front part of the top supports being pivotally secured by the shaft in front of the center of gravity of the top; and a hydraulic locking gas spring unit for tilting the top comprising a hydraulic unlocking unit which is provided on a lower surface of a front part of said top, one end of the hydraulic locking gas spring is pivotally coupled to the top in a first recess, and another end of the hydraulic locking gas spring is pivotally coupled to the top support, the first recess being located in the lower surface of the top behind the center of gravity of the top with respect to the front part of the top.

* * * * *